US011779513B2

(12) United States Patent
Tang

(10) Patent No.: US 11,779,513 B2
(45) **Date of Patent: *Oct. 10, 2023**

(54) MASSAGER FOR MALE GENITALIA

(71) Applicant: Yiqun Tang, Ji'an (CN)

(72) Inventor: Yiqun Tang, Ji'an (CN)

(73) Assignee: Yiqun Tang, Ji'an (CN)

( * ) Notice: Subject to any disclaimer, the term of this patent is extended or adjusted under 35 U.S.C. 154(b) by 302 days.

This patent is subject to a terminal disclaimer.

(21) Appl. No.: 17/195,656

(22) Filed: Mar. 9, 2021

(65) Prior Publication Data

US 2021/0186798 A1 Jun. 24, 2021

(51) Int. Cl.
*A61H 19/00* (2006.01)

(52) U.S. Cl.
CPC ..... *A61H 19/32* (2013.01); *A61H 2201/1215* (2013.01); *A61H 2201/50* (2013.01)

(58) Field of Classification Search
CPC ..... A61H 19/32; A61H 2201/1215; A61H 2201/50; A61H 2201/0153; A61H 2201/149; A61H 2201/1669; A61H 2201/169; A61H 2201/5023
See application file for complete search history.

(56) References Cited

U.S. PATENT DOCUMENTS

| | | | | |
|---|---|---|---|---|
| 10,195,105 | B2 * | 2/2019 | Cambridge | A61H 19/32 |
| 2017/0340501 | A1 * | 11/2017 | Lin | A61H 19/30 |
| 2018/0140502 | A1 * | 5/2018 | Shahoian | A61H 19/44 |
| 2020/0315909 | A1 * | 10/2020 | Cambridge | A61H 1/00 |

FOREIGN PATENT DOCUMENTS

| | | | | |
|---|---|---|---|---|
| CN | 110339044 A | * | 10/2019 | A61F 5/41 |
| CN | 109106401 B | * | 7/2021 | A61B 10/0058 |

* cited by examiner

*Primary Examiner* — Thaddeus B Cox
*Assistant Examiner* — Marc D. Honrath
(74) *Attorney, Agent, or Firm* — Nitin Kaushik

(57) ABSTRACT

The present application provides a massager for male genitalia. A user may insert his penis into a massage sleeve through an opening. A relative movement is generated between the massage sleeve and the penis to simulate a thrusting motion during sexual intercourse. The massage sleeve simulates a vaginal environment, and performs a massage to provide massaging stimulation, and a reciprocating movement to provide reciprocating stimulation, or the like. In addition, the massage of the user's penis is implemented during the simulation of a back-and-forth thrusting motion. Therefore, an all-around automatic massage of the penis is implemented, and the entire massage process is relaxing and pleasurable.

8 Claims, 4 Drawing Sheets

MASSAGER FOR MALE GENITALIA

TECHNICAL FIELD

The present invention relates to the field of massagers for men, and in particular, to a massager for male genitalia.

BACKGROUND

Male sexual dysfunction means that one or several or all of five stages of sexual activities including sexual arousal, penis erection, sexual intercourse, orgasm, and ejaculation encounter abnormalities to affect normal sexual activity. The most common sexual dysfunction is anomalies in penis erection and ejaculation. Male sexual function is a complex physiological process that involves various aspects such as neurological factors, psychological factors, endocrine functions, and a sexual organ. The sexual organ herein is a man's penis.

Erectile dysfunction, also called "impotence", means that when a man and a woman perform sexual activity, the penis fails to erect, is erect but not rigid enough, or is rigid for a very short time, and as a result fails to accomplish normal sexual activity. It needs to be noted that if sexual activity only fails occasionally, it should not be subjectively considered that the man has erectile dysfunction. The dysfunction can be diagnosed only when the failure rate of sexual activity exceeds one fourth. The probability of erectile dysfunction can be effectively reduced through exercise; however, office workers generally have little time for exercise.

At present, commercially available products for massaging and exercising men's penises have simple structures and unvaried functions, and the functions and structures still need to be enhanced.

SUMMARY

To resolve the foregoing problem, the present invention provides a massager for male genitalia, to implement an all-around automatic massage of a user's penis and treat male hypoactive sexual desire disorder, premature ejaculation, erectile dysfunction, sexual dysfunction, and the like.

To achieve the foregoing objective, the technical solution used in the present invention is as follows: A massager for male genitalia includes: a massage housing provided with an opening at an end, where a push unit, a rotation unit, a control unit, and a massage sleeve are provided in the massage housing, the massage sleeve is placed along an axial direction of the massage housing and is aligned with the opening of the massage housing, the push unit and the rotation unit are both electrically connected to the control unit, the rotation unit is drivingly connected to the massage sleeve and drives the massage sleeve to rotate around an axis of the massage sleeve, and the push unit is drivingly connected to the rotation unit and drives the massage sleeve to make a reciprocating movement in an axial direction of the massage sleeve;

the rotation unit includes a first motor connecting seat and a first drive motor that is electrically connected to the control unit, where the first motor connecting seat is disposed on an inner wall of the massage housing, a motor mounting hole corresponding to the first drive motor is disposed in the first motor connecting seat, the first drive motor is placed in the motor mounting hole, and an output shaft of the first drive motor passes through the first motor connecting seat in the axial direction of the massage sleeve and is connected to the massage sleeve; and the push unit includes a second motor connecting seat, a connecting rod, a slidable push rod placed in a length direction of the massage sleeve, two slidable guide rods that extend in the length direction of the massage sleeve and are fixed on the inner wall of the massage housing, and a second drive motor electrically connected to the control unit, where the second drive motor is fixedly disposed in the massage housing by the second motor connecting seat, an output shaft of the second drive motor is connected to one end of the connecting rod, and a swing rod is vertically connected to the other end of the connecting rod; a surface at one end of the slidable push rod is provided with a slotted hole in which the swing rod is fitted and which extends in a direction perpendicular to a length direction of the slidable push rod; and the other end of the slidable push rod is fixedly connected to a top end of the first motor connecting seat, a slidable support is fixedly disposed on each of two sides of a top surface of the first motor connecting seat, and the slidable support is slidably sleeved over the slidable guide rod and moves along a direction of the slidable guide rod.

Further, the rotation unit further includes a first motor fixing seat which is sleeved over an end of the first drive motor away from the output shaft of the first drive motor, and fixedly disposed on a side of the first motor connecting seat.

Further, the massage sleeve includes an inner core, a middle housing, and a rotating housing connected to the output shaft of the first drive motor, where the inner core is mounted in the middle housing, a mounting dome is disposed on an outer side surface of the middle housing, a first mounting notch corresponding to the mounting dome is disposed on an outer side surface of the rotating housing, the middle housing is mounted in the rotating housing, and the mounting dome is clamped on the first mounting notch.

Further, a protruding portion extending in a length direction of the middle housing is further disposed on each of two sides of the outer side surface of the middle housing, a second mounting notch corresponding to the protruding portion is disposed on each of the two sides of the outer side surface of the rotating housing, the middle housing is mounted in the rotating housing, and the protruding portion extends beyond the second mounting notch.

Further, the inner core is made of TPE-0, and a plurality of massage pillars integrally formed with the inner core are evenly disposed on an inner side wall of the inner core.

Further, a battery unit is further disposed in the massage housing and is connected to the control unit.

Further, a plurality of control buttons are disposed on a surface of the massage housing and are electrically connected to the control unit.

Further, a charging interface is further disposed at an end of the massage housing away from the opening, and is electrically connected to the control unit.

The beneficial effects of the present invention lie in that:

1. After the penis becomes erect, a user may insert his penis into the massage sleeve through the opening and start the push unit and the rotation unit by the control unit. The second drive motor is started to drive the swing rod to rotate around the center of an output shaft of the swing rod. Because the swing rod falls in the slotted hole, when the swing rod rotates, a back-and-forth displacement is generated, to drive the entire slidable support to move back and forth. Therefore, it can be implemented that the massage sleeve is driven to reciprocate in the length direction of the massage sleeve. That is, a relative movement is generated between the massage sleeve and the penis to simulate a thrusting motion during sexual intercourse. The massage sleeve simulates a vaginal environment, and performs a massage to provide massaging stimulation, a reciprocating movement to provide reciprocating stimulation, or the like. In addition, while the push unit drives the massage sleeve to make a reciprocating movement in an axial direction of the massage sleeve, the first drive motor drives the massage sleeve to rotate, and a circumferential massage of the user's penis is implemented during the simulation of a back-and-forth thrusting motion. Therefore, the all-around automatic massage of the user's penis can be implemented, and the entire massage process is relaxing and pleasurable. The penis glans is repeatedly stroked and massaged, to reduce the excitement of sexual nerve endings, make the nerves in the surfaces of the penis glans, the penis crown, and the corpus penis less sensitive, and adjust the sexual nerve center, thereby reducing the sensitivity of the sexual nerve and increasing the ejaculation threshold, so that the probability of erectile dysfunction can be effectively reduced.

2. With the spread and application of the present invention, the sexual welfare of men is improved, crime can be reduced, the spread of sexually transmitted diseases and AIDS are effectively avoided, families can be closer and more united, the society can be more stable and harmonious, and objective economic and social benefits are produced.

Figure 1:
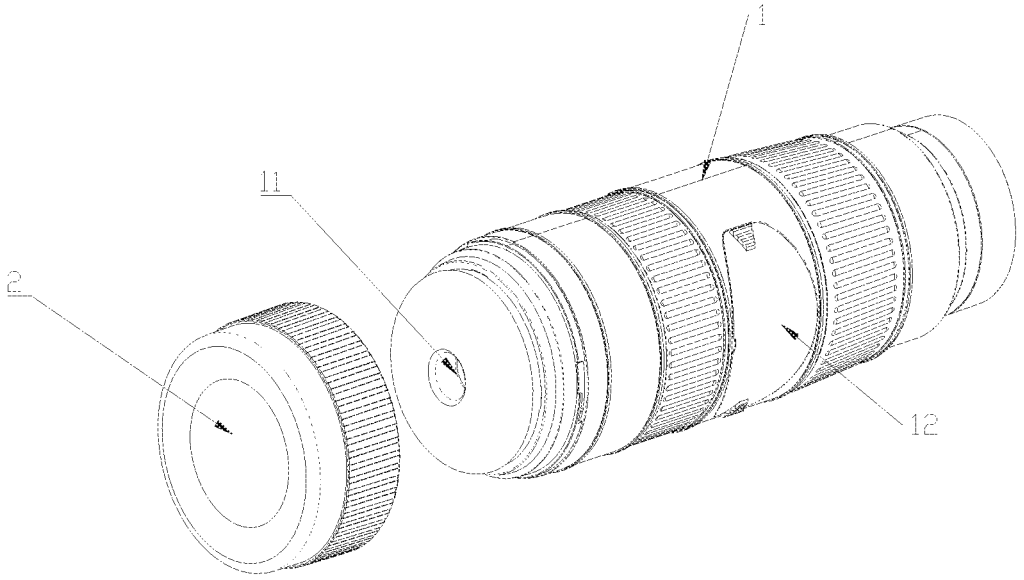
FIG. 1 is a schematic perspective view of an overall device according to the present invention.

Reference numerals: 1. massage housing; 11. opening; 12. seal cover; 13. massage sleeve; 131. inner core; 1311. massage pillar; 132. middle housing; 1321. protruding portion; 1322. mounting dome; 133. rotating housing; 1331. first mounting notch; 1332. second mounting notch; 141. second motor connecting seat; 142. second drive motor; 143. connecting rod; 144. swing rod; 145. slidable push rod; 1451. slotted hole; 146. slidable support; 147. slidable guide rod; 151. first motor connecting seat; 152. first motor fixing seat; 153. first drive motor; 16. control unit; 17. battery unit; and 2. massage cover.

DETAILED DESCRIPTION

Referring to FIG. 1 to FIG. 5, the present invention relates to a massager for male genitalia, including a massage housing 1 provided with an opening 11 at an end, and a massage cover 2 covering the opening 11 of the massage housing 1. A push unit, a rotation unit, a control unit 16, and a massage sleeve 13 are provided in the massage housing 1. The massage sleeve 13 is placed along an axial direction of the massage housing 1 and is aligned with the opening 11 of the massage housing 1. The push unit and the rotation unit are both electrically connected to the control unit 16. The rotation unit is drivingly connected to the massage sleeve 13 and drives the massage sleeve 13 to rotate around an axis of the massage sleeve 13. The push unit is drivingly connected to the rotation unit and drives the massage sleeve 13 to make a reciprocating movement in an axial direction of the massage sleeve 13.

After the penis becomes erect, a user may insert his penis into the massage sleeve 13 through the opening 11 and start the push unit and the rotation unit by the control unit 16. A second drive motor 142 is started to drive a swing rod 144 to rotate around the center of an output shaft of the swing rod 144. Because the swing rod 144 falls in a slotted hole 1451, when the swing rod 144 rotates, a back-and-forth displacement is generated, to drive an entire slidable support 146 to move back and forth. The slidable support 146 can be driven to be slidably sleeved over a slidable guide rod 147 and move along a direction of the slidable guide rod 147. Therefore, it can be implemented that the massage sleeve 13 is driven to reciprocate in a length direction of the massage sleeve 13. That is, a relative movement is generated between the massage sleeve 13 and the penis to simulate a thrusting motion during sexual intercourse. The massage sleeve 13 simulates a vaginal environment, and performs a massage to provide massaging stimulation, a reciprocating movement to provide reciprocating stimulation, or the like. In addition, as the push unit drives the massage sleeve 13 to make the reciprocating movement in the axial direction of the massage sleeve 13, a first drive motor 153 drives the massage sleeve 13 to rotate, and a circumferential massage of the user's penis is implemented during the simulation of a back-and-forth thrusting motion. Therefore, an all-around automatic massage of the user's penis can be implemented, and the entire massage process is relaxing and pleasurable. The penis glans is repeatedly stroked and massaged, to reduce the excitement of sexual nerve endings, make the nerves in the surfaces of the penis glans, the penis crown, and the corpus penis less sensitive, and adjust the sexual nerve center, thereby reducing the sensitivity of the sexual nerve and increasing the ejaculation threshold, so that the probability of erectile dysfunction can be effectively reduced. With the spread and application of the present invention, the sexual welfare of men is improved, crime can be reduced, the spread of sexually transmitted diseases and AIDS are effectively avoided, families can be closer and more united, the society can be more stable and harmonious, and objective economic and social benefits are produced.

Figure 2:
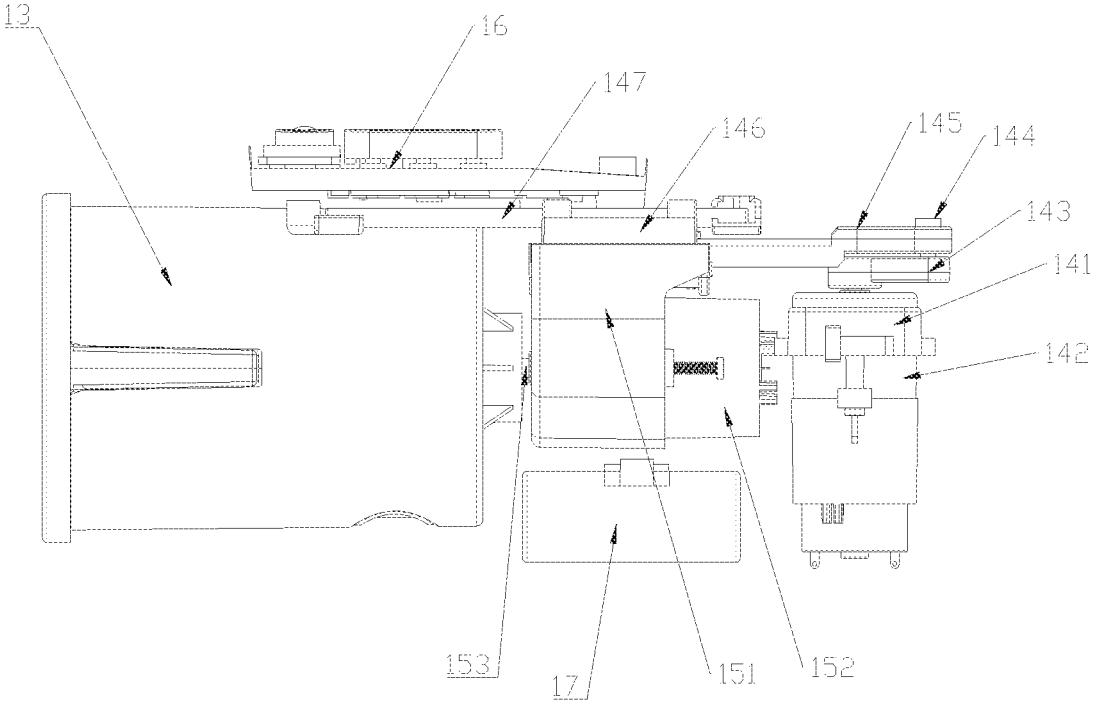
FIG. 2 is a structural side view after a push unit, a rotation unit, a control unit, and a massage sleeve are assembled according to the present invention.
Figure 3:
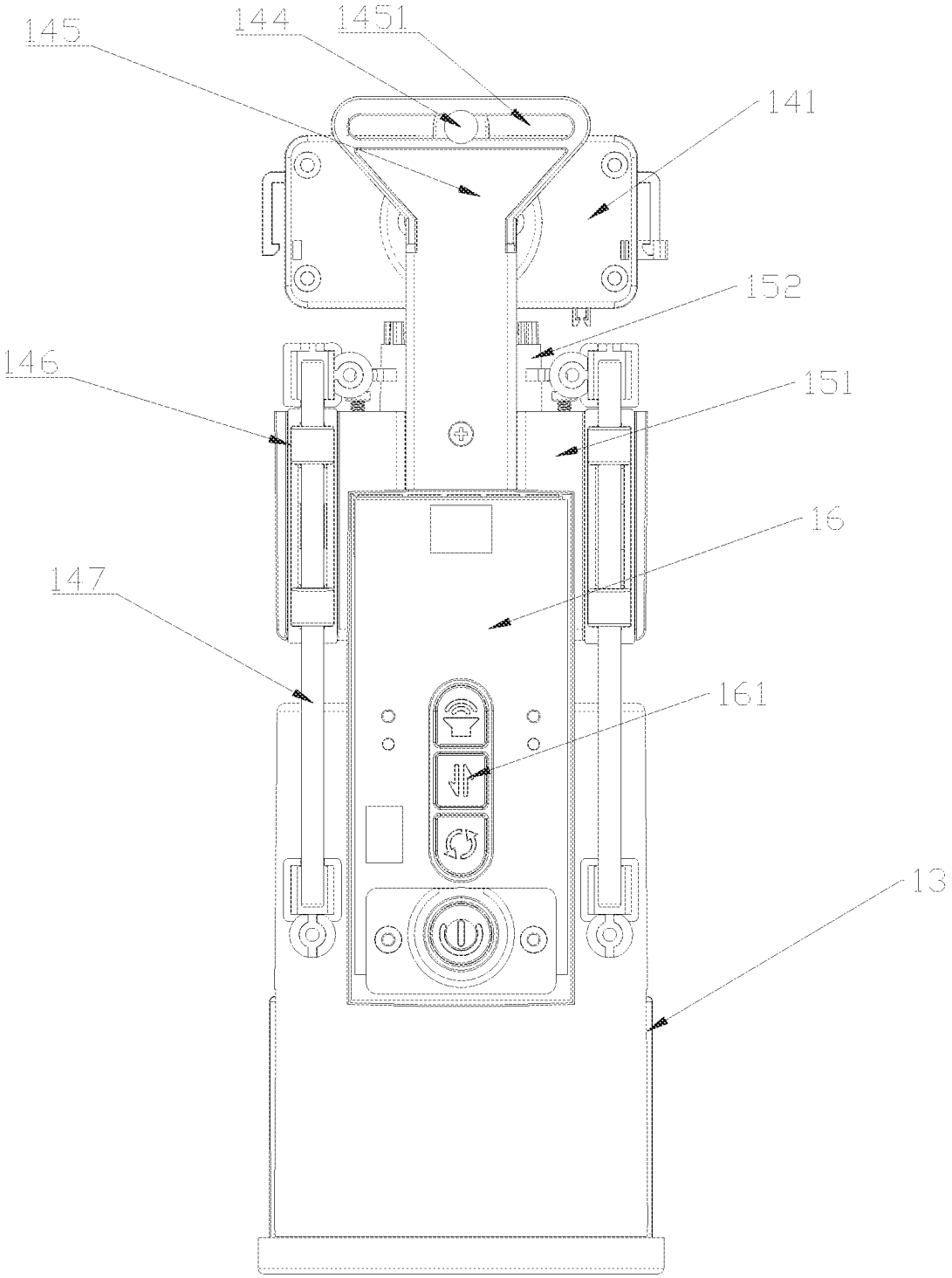
FIG. 3 is a structural top view after a push unit, a rotation unit, a control unit, and a massage sleeve are assembled according to the present invention.

Referring to FIG. 2 and FIG. 3, in this embodiment, the rotation unit includes a first motor connecting seat 151 and the first drive motor 153 that is electrically connected to the control unit 16. The first motor connecting seat 151 is disposed on an inner wall of the massage housing 1. A motor mounting hole corresponding to the first drive motor 153 is disposed in the first motor connecting seat 151. The first drive motor 153 is placed in the motor mounting hole. An output shaft of the first drive motor 153 passes through the first motor connecting seat in the axial direction of the massage sleeve 13 and is connected to the massage sleeve 13. The first drive motor 153 drives the massage sleeve 13 to rotate, to implement a circumferential massage of the user's penis. In addition, the rotation unit further includes a first motor fixing seat 152. The first motor fixing seat 152 is sleeved over an end of the first drive motor 153 away from the output shaft of the first drive motor 153. The first motor fixing seat 152 is fixedly disposed on a side of the first motor connecting seat 151. The first drive motor 153 is stably fixed on a side of the first motor connecting seat 151 by the first motor fixing seat 152, to prevent the first drive motor 153 from shaking or deviation in a working process.

The foregoing specific implementations of the rotation unit are merely descriptions of preferred implementations of the present invention and are not used to limit the scope of the present invention. Various variations and improvements made by a person of ordinary skill in the art to the specific technical solutions of the rotation unit in the present invention without departing from the design spirit of the present invention shall fall within the protection scope determined by the claims of the present invention.

Referring to FIG. 2 and FIG. 3, further, the push unit includes a second motor connecting seat 141, a slidable push rod 145 placed in the length direction of the massage sleeve 13, a connecting rod 143, two slidable guide rods 147 that extend in the length direction of the massage sleeve 13 and are fixed on the inner wall of the massage housing 1, and the second drive motor 142 electrically connected to the control unit 16. The second drive motor 142 is fixedly disposed in the massage housing 1 by the second motor connecting seat 141. An output shaft of the second drive motor 142 is connected to one end of the connecting rod 143. The swing rod 144 is vertically connected to the other end of the connecting rod 143. A surface at one end of the slidable push rod 145 is provided with the slotted hole 1451 in which the swing rod 144 is fitted and which extends in a direction perpendicular to a length direction of the slidable push rod 145. The other end of the slidable push rod 145 is fixedly connected to a top end of the first motor connecting seat 151. The slidable support 146 is fixedly disposed on each of two sides of a top surface of the first motor connecting seat 151. The slidable support 146 is slidably sleeved over the slidable guide rod 147 and moves along the direction of the slidable guide rod 147. The second drive motor 142 is started to drive the swing rod 144 to rotate around the center of the output shaft of the swing rod 144. Because the swing rod 144 falls in the slotted hole 1451, when the swing rod 144 rotates, a back-and-forth displacement is generated, to drive the entire slidable support 146 to move back and forth. The slidable support 146 can be driven to be slidably sleeved over the slidable guide rod 147 and move along the direction of the slidable guide rod 147. Therefore, it can be implemented that the massage sleeve 13 is driven to reciprocate in the length direction of the massage sleeve 13.

Similarly, the foregoing specific implementations of the push unit are merely descriptions of preferred implementations of the present invention and are not used to limit the scope of the present invention. Various variations and improvements made by a person of ordinary skill in the art to the specific technical solutions of the push unit in the present invention without departing from the design spirit of the present invention shall fall within the protection scope determined by the claims of the present invention.

Figure 4:
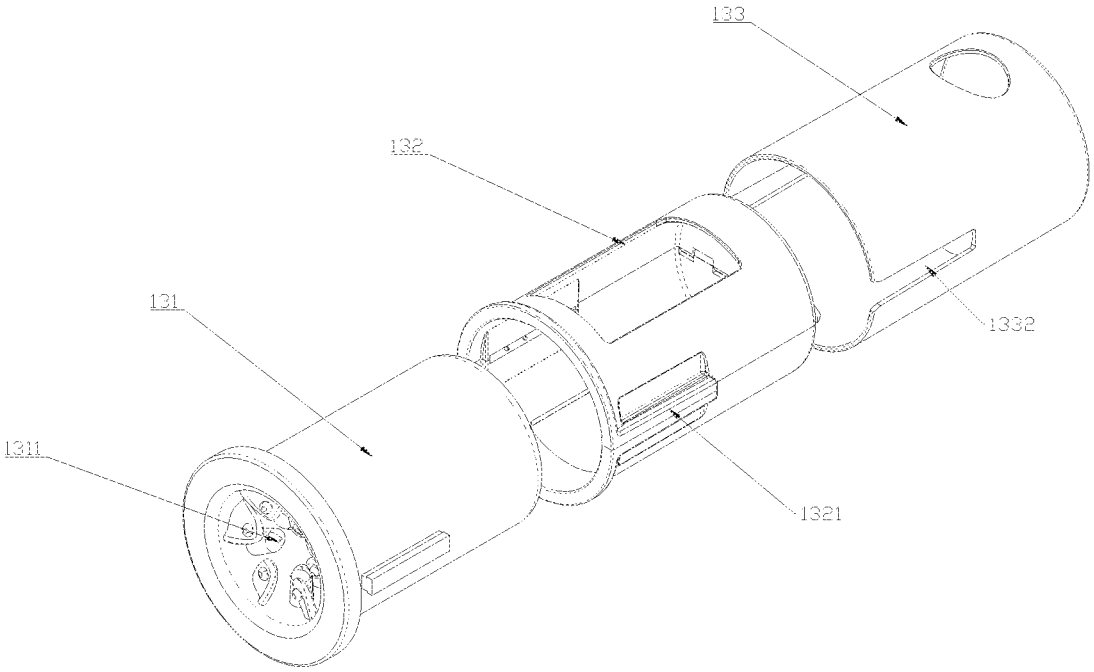
FIG. 4 is an exploded schematic perspective view of a massage sleeve according to the present invention.
Figure 5:
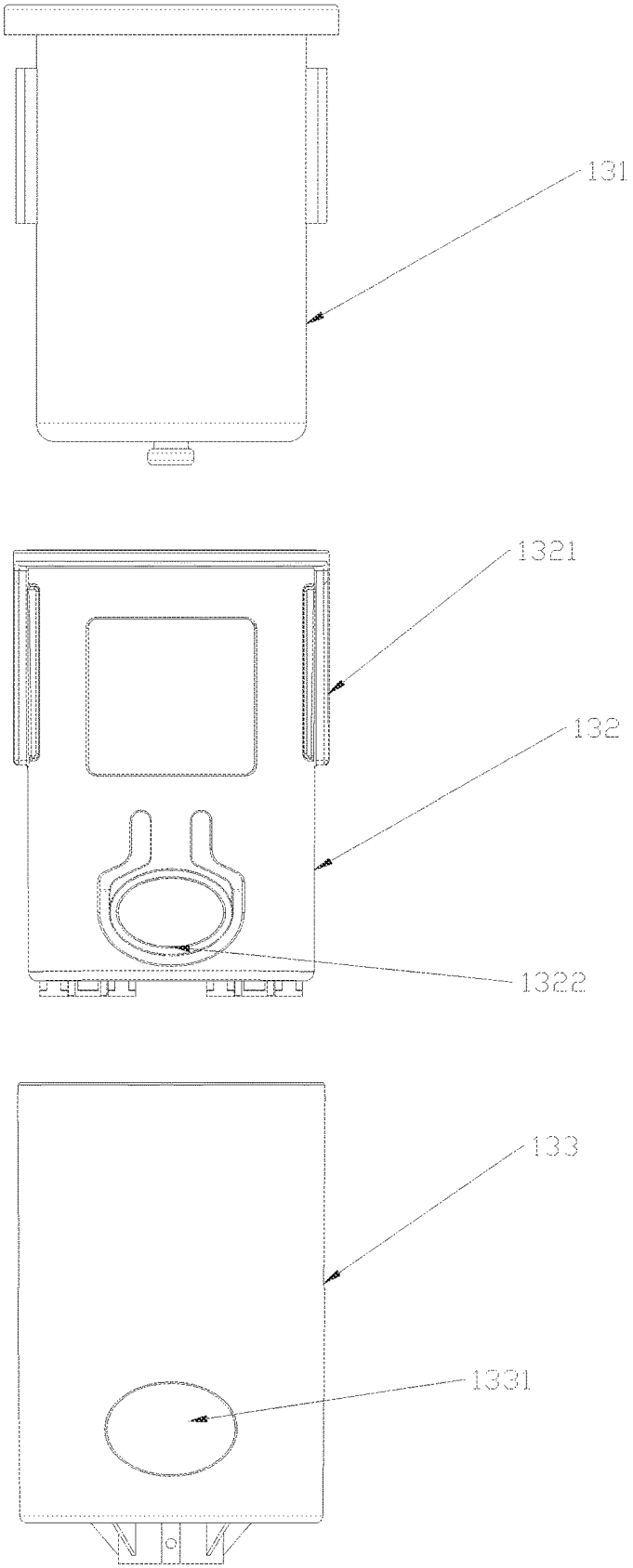
FIG. 5 is an exploded schematic top view of a massage sleeve according to the present invention.

Referring to FIG. 4 and FIG. 5, further, the massage sleeve 13 includes an inner core 131, a middle housing 132, and a rotating housing 133 connected to the output shaft of the first drive motor 153. The inner core 131 is mounted in the middle housing 132. A mounting dome 1322 is disposed on an outer side surface of the middle housing 132. A first mounting notch 1331 corresponding to the mounting dome 1322 is disposed on an outer side surface of the rotating housing 133. The middle housing 132 is mounted in the rotating housing 133. The mounting dome 1322 is clamped on the first mounting notch 1331. In addition, a detachment opening is further provided in the massage housing 1 at a position corresponding to the first mounting notch 1331, and a seal cover 12 covers the detachment opening. During daily use, to make it convenient for the user to clean the massage sleeve 13 after ejaculation, when the massage sleeve 13 needs to be cleaned, the user first unscrews the massage cover 2 located at the opening 11, and then opens the seal cover 12. The user presses the mounting dome 1322 to detach the mounting dome 1322 from the first mounting notch 1331, and then removes the middle housing 132 and the inner core 131 disposed in the middle housing 132 from the opening 11. Therefore, the user may directly clean the inner core 131 and dry the inner core 131 for use next time.

Further, the middle housing 132 includes an upper middle housing and a lower middle housing. An end of the upper middle housing away from the opening 11 is hinged to an end of the lower middle housing away from the opening 11. When the user removes the middle housing 132 and the inner core 131 disposed in the middle housing 132, to further make it convenient for the user to remove the inner core 131, the ends of the upper middle housing and the lower middle housing are hinged, so that the middle housing 132 is in an openable state.

Referring to FIG. 4 and FIG. 5, further, a protruding portion 1321 extending in a length direction of the middle housing is further disposed on each of two sides of the outer side surface of the middle housing. A second mounting notch 1332 corresponding to the protruding portion 1321 is disposed on each of the two sides of the outer side surface of the rotating housing 133. The middle housing is mounted in the rotating housing 133. The protruding portion 1321 extends beyond the second mounting notch 1332. In this embodiment, because the rotation unit drives the massage sleeve 13 to rotate, in order to avoid slippage between the middle housing and the rotating housing 133, the protruding portion 1321 is disposed on an outer side wall of the middle housing, and at the same time the second mounting notch 1332 corresponding to the protruding portion 1321 is disposed on each of two sides of the outer side surface of the rotating housing 133. The middle housing is mounted in the rotating housing 133. The protruding portion 1321 extends beyond the second mounting notch 1332.

Referring to FIG. 4 and FIG. 5, further, the inner core 131 is made of TPE-0 which is a very soft elastomer material. A plurality of massage pillars 1311 integrally formed with the inner core 131 are evenly disposed on an inner side wall of the inner core 131. The industry of adult sex-related products develops vigorously, and there is a growing demand for ultra-soft TPE. 0 refers to the Shore A0 hardness. The ultra-soft TPE is transparent or opaque beads that are nontoxic and odorless, and is an environmentally friendly soft gel material. The TPE-0 material has excellent elasticity and tensile elongation (the elongation may be up to 1500%), and can provide the feel of silicone to replace a silicone material, so that the material provides great skin feel and can better fit male genitalia. The TPE-0 material has the advantages of comfortable softness and low stimulation to skin. In addition, the TPE-0 is deformable to adapt to the use of different customers. In addition, the delicate feel of TPE-0 can greatly improve the use experience of the user.

Further, a battery unit 17 is further disposed in the massage housing 1. The battery unit 17 is connected to the control unit 16. Further, a charging interface is further disposed at an end of the massage housing 1 away from the opening 11. The charging interface is electrically connected to the control unit 16. The user can charge directly through the charging interface. In addition, with the battery unit 17, the overall device can be used without connecting the device to mains by an electric cable.

Further, a plurality of control buttons are disposed on a surface of the massage housing 1. The control buttons are electrically connected to the control unit 16. In this embodiment, the user can use the control buttons to control the activation of the first drive motor 153 and the second drive motor 142, that is, to control the activation of a rotation function or a push function.

The foregoing implementations are merely descriptions of preferred implementations of the present invention and are not used to limit the scope of the present invention. Various variations and improvements made by a person of ordinary skill in the art to the technical solutions of the present invention without departing from the design spirit of the present invention shall fall within the protection scope determined by the claims of the present invention.

What is claimed is:

1. A massager for male genitalia, comprising a massage housing provided with an opening at an end, wherein a push unit, a rotation unit, a control unit, and a massage sleeve are provided in the massage housing, the massage sleeve is placed along an axial direction of the massage housing and is aligned with the opening of the massage housing, the push unit and the rotation unit are both electrically connected to the control unit, the rotation unit is drivingly connected to the massage sleeve and drives the massage sleeve to rotate around an axis of the massage sleeve, and the push unit is drivingly connected to the rotation unit and drives the massage sleeve to make a reciprocating movement in an axial direction of the massage sleeve;

the rotation unit comprises a first motor connecting seat and a first drive motor that is electrically connected to the control unit, the first motor connecting seat is disposed on an inner wall of the massage housing, a motor mounting hole corresponding to the first drive motor is disposed in the first motor connecting seat, the first drive motor is placed in the motor mounting hole, and an output shaft of the first drive motor passes through the first motor connecting seat in the axial direction of the massage sleeve and is connected to the massage sleeve; and the push unit comprises a second motor connecting seat, a connecting rod, a slidable push rod placed in a length direction of the massage sleeve, two slidable guide rods that extend in the length direction of the massage sleeve and are fixed on the inner wall of the massage housing, and a second drive motor electrically connected to the control unit, the second drive motor is fixedly disposed in the massage housing by the second motor connecting seat, an output shaft of the second drive motor is connected to one end of the connecting rod, and a swing rod is vertically connected to the other end of the connecting rod; a surface at one end of the slidable push rod is provided with a slotted hole in which the swing rod is fitted and which extends in a direction perpendicular to a length direction of the slidable push rod, and the other end of the slidable push rod is fixedly connected to a top end of the first motor connecting seat, a slidable support is fixedly disposed on each of two sides of a top surface of the first motor connecting seat, and the slidable support is slidably sleeved over the slidable guide rod and moves along a direction of the slidable guide rod.

2. The massager for male genitalia according to claim 1, wherein the rotation unit further comprises a first motor fixing seat, the first motor fixing seat is sleeved over an end of the first drive motor away from the output shaft of the first drive motor, and is fixedly disposed on a side of the first motor connecting seat.

3. The massager for male genitalia according to claim 1, wherein the massage sleeve comprises an inner core, a middle housing, and a rotating housing connected to the output shaft of the first drive motor, the inner core is mounted in the middle housing, a mounting dome is disposed on an outer side surface of the middle housing, a first mounting notch corresponding to the mounting dome is disposed on an outer side surface of the rotating housing, the middle housing is mounted in the rotating housing, and the mounting dome is clamped on the first mounting notch.

4. The massager for male genitalia according to claim 3, wherein a protruding portion extending in a length direction of the middle housing is further disposed on each of two sides of the outer side surface of the middle housing, a second mounting notch corresponding to the protruding portion is disposed on each of the two sides of the outer side surface of the rotating housing, the middle housing is mounted in the rotating housing, and the protruding portion extends beyond the second mounting notch.

5. The massager for male genitalia according to claim 3, wherein the inner core is made of TPE-0, and a plurality of massage pillars integrally formed with the inner core are evenly disposed on an inner side wall of the inner core.

6. The massager for male genitalia according to claim 1, wherein a battery unit is further disposed in the massage housing and is connected to the control unit.

7. The massager for male genitalia according to claim 1, wherein a plurality of control buttons are disposed on a surface of the massage housing and are electrically connected to the control unit.

8. The massager for male genitalia according to claim 1, wherein a charging interface is further disposed at an end of the massage housing away from the opening and is electrically connected to the control unit.

* * * * *